US006755030B2

(12) United States Patent
Adaniya et al.

(10) Patent No.: US 6,755,030 B2
(45) Date of Patent: Jun. 29, 2004

(54) HYBRID COMPRESSOR SYSTEM

(75) Inventors: Taku Adaniya, Kariya (JP); Akinobu Kanai, Kariya (JP); Takahiro Suzuki, Kariya (JP); Shoichi Ieoka, Kariya (JP); Naoki Usui, Kariya (JP); Akihito Yamanouchi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/446,415

(22) Filed: May 28, 2003

(65) Prior Publication Data

US 2004/0035127 A1 Feb. 26, 2004

(30) Foreign Application Priority Data

May 29, 2002 (JP) ..... 2002-155658

(51) Int. Cl.[7] ..... F25B 27/00

(52) U.S. Cl. ..... 62/115; 62/236; 62/323.4; 417/374

(58) Field of Search ..... 62/115, 236, 323.4; 417/374, 142, 16, 280

(56) References Cited

U.S. PATENT DOCUMENTS 6,247,899 B1 * 6/2001 Ban et al. ..... 417/16
6,287,081 B1 * 9/2001 Tamegai et al. ..... 417/15
6,351,957 B2 * 3/2002 Hara ..... 62/133
6,375,436 B1 * 4/2002 Irie et al. ..... 417/223
6,619,929 B2 * 9/2003 Adaniya et al. ..... 417/223
6,638,027 B2 * 10/2003 Mohrmann ..... 417/223
6,675,592 B2 * 1/2004 Huang et al. ..... 62/176.6
6,675,596 B2 * 1/2004 Iwanami et al. ..... 62/236
2003/0041603 A1 * 3/2003 Tada et al. ..... 62/134
2004/0009073 A1 * 1/2004 Sato et al. ..... 417/15

FOREIGN PATENT DOCUMENTS

JP 2002-67673 3/2002

* cited by examiner

*Primary Examiner*—William E. Tapolcai
(74) *Attorney, Agent, or Firm*—Woodcock Washburn LLP

(57) ABSTRACT

A hybrid compressor system has a hybrid compressor for compressing refrigerant. The compressor is selectively driven by one of a first drive source and a second drive source. The hybrid compressor system also includes a first one-way clutch, a driver for driving the second drive source, a sensor for detecting a rotational state of the first drive source and a controller. The first one-way clutch is arranged on a first power transmission path between the compressor and the first drive source for permitting power transmission from the first drive source to the compressor. The controller is electrically connected to the driver and the sensor. When a drive source of the compressor is switched from the second drive source to the first drive source, the controller orders the driver to stop the second drive source after the rotation of the first drive source is detected.

13 Claims, 2 Drawing Sheets

HYBRID COMPRESSOR SYSTEM

BACKGROUND OF THE INVENTION

The present invention relates to a hybrid compressor system including a hybrid compressor, a drive source of which is switched between an electric motor and an engine for driving a vehicle, for compressing refrigerant.

A hybrid compressor in an air conditioning system for a vehicle is disclosed in Japanese Unexamined Patent Publication No. 2002-67673. An electromagnetic clutch is arranged on a power transmission path between the engine and the hybrid compressor. When a drive source of the hybrid compressor is switched from an electric motor to an engine, the electromagnetic clutch is switched on or connected after a rotational speed of the electric motor becomes equal to a rotational speed of the engine.

Therefore, even when the drive source is switched, the hybrid compressor continuously compresses refrigerant. Namely, air conditioning is continuously conducted by the air conditioning system. Therefore, comfortable cooling feeling can be offered. Furthermore, since the drive source is smoothly switched, unpleasant shock caused by a rotational speed differential between the hybrid compressor and the engine upon switching on the electromagnetic clutch can be avoided.

However, a complicated control, in which the electric clutch is switched on after the rotational speed of the electric motor becomes equal to the rotational speed of the engine, is required. Therefore, a computing load on a control device increases.

SUMMARY OF THE INVENTION

The present invention provides a hybrid compressor system that smoothly switches a drive source of a hybrid compressor from an electric motor to an engine without a break of air conditioning and a complicated control.

In accordance with a preferred embodiment of the present invention, a hybrid compressor system has a hybrid compressor for compressing refrigerant, a first drive source, and a second drive source. The first drive source is operatively connected to the compressor through a first power transmission path. The second drive source is operatively connected to the compressor through a second power transmission path. The compressor is selectively driven by one of the first drive source and the second drive source. The hybrid compressor system also includes a first one-way clutch, a driver for driving the second drive source, a sensor for detecting a rotational state of the first drive source and a controller. The first one-way clutch is arranged on the first power transmission path between the compressor and the first drive source for permitting power transmission from the first drive source to the compressor. The controller is electrically connected to the driver and the sensor. When a drive source of the compressor is switched from the second drive source to the first drive source, the controller orders the driver to stop the second drive source after the rotation of the first drive source is detected.

The present invention also provides a method for switching a drive source of a hybrid compressor from a stopped state of an engine for running a vehicle to a normal running state. The compressor is operatively connected to the engine through a power transmission path and selectively driven by one of the engine and an electric motor. A starter motor is operatively connected to the engine. A preferred method includes the steps of providing a one-way clutch on the power transmission path between the compressor and the engine, driving the compressor by the electric motor during an idle stop of the vehicle, detecting a rotational speed of the engine, driving the electric motor such that the electric motor drives the hybrid compressor at a second predetermined speed when the rotational speed of the engine is detected, and stopping the electric motor when the detected rotational speed of the engine exceeds a predetermined value. The predetermined value ranges between a third predetermined rotational speed of the engine that corresponds to a first predetermined rotational speed of the compressor and a fourth rotational speed of the engine that corresponds to the second predetermined rotational speed of the compressor. The compressor is driven at the first predetermined rotational speed when power is transmitted from the starter motor to the compressor through the engine.

BRIEF DESCRIPTION OF THE DRAWINGS

The features of the present invention that are believed to be novel are set forth with particularity in the appended claims. Aspect of the invention may best be understood by reference to the following description of the presently preferred embodiments together with the accompanying drawings in which:

FIG. 3(*b*) is a timing graph illustrating rotational speeds of the engine and the electric motor unit regarding the control In FIG. 2.

DETAILED DESCRIPTION OF THE PREFERRED EMBODIMENTS

Figure 1:
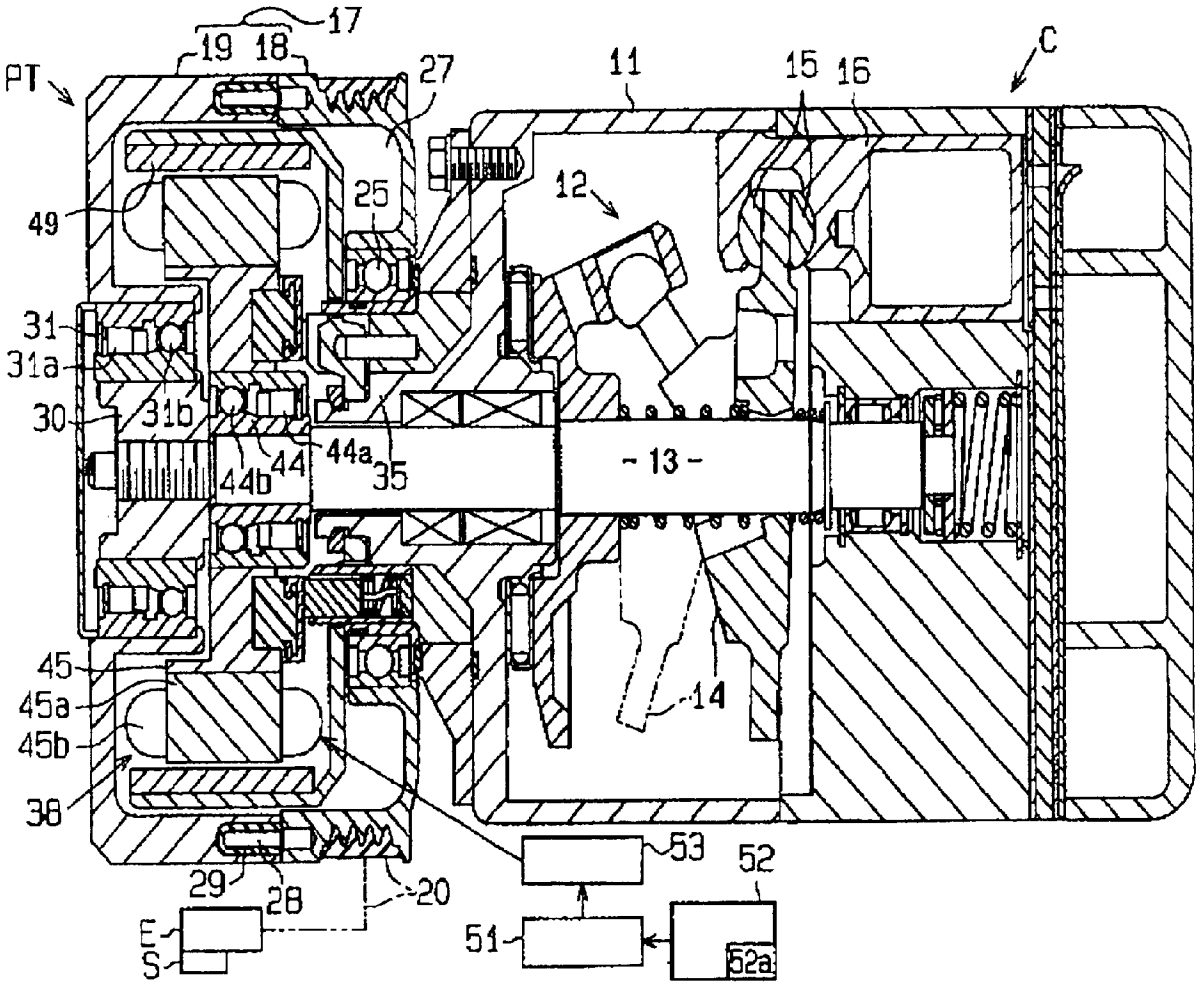
FIG. 1 is a longitudinal cross-sectional view of a compressor.

A preferred embodiment according to the present invention will be described now. As shown in FIG. 1, a hybrid compressor C, which constitutes a refrigerating cycle in an air conditioning system for a vehicle, has a housing 11 for compressing refrigerant. A piston type variable displacement compression unit 12 is accommodated in the housing 11. The compression unit 12 includes a rotary shaft 13, a swash plate 14, a pair of shoes 15 and a piston 16. The swash plate 14 is rotated by the rotation of the rotary shaft 13. The rotational movement of the swash plate 14 is converted into the reciprocating movement of the piston 16, thereby compressing a refrigerant gas.

A power transmission mechanism Pr is arranged at one end of the housing 11 outside the housing 11, such that the axis of the power transmission mechanism PT corresponds to the axis of the rotary shaft 13, for transmitting power to the rotary shaft 13. The power transmission mechanism PT includes a pulley 17 and an electric motor unit 38 as an electric motor or a second drive source.

The pulley 17 is rotatably supported by the housing 11. The pulley 17 transmits power from an engine E (internal combustion engine) as a first drive source for driving a vehicle to the rotary shaft 13. A starter motor S is operatively coupled to the engine E for starting up the engine E. During a starting period of the engine E by the starter motor S, or during a time when the starter motor S starts the engine E, power is transmitted from the starter motor S to the pulley 17 via the engine E. In the present specification, a rotational state of the engine E includes not only a independent rotation of the engine E but also a dependent rotation of the engine E when driven by the starter motor S.

The electric motor unit 38 is utilized to drive the rotary shaft 13 when the engine E is in a stopped state. The air conditioning system includes the electric motor unit 38. Therefore, air conditioning is capable of being continuously conducted even when the engine E is in the stopped state. The air conditioning system in the present preferred embodiment is suitable for an idle stop vehicle and a hybrid vehicle.

Next, an exemplary power transmission mechanism PT will be described. The rotary shaft 13 of the compression unit 12 is rotatably supported by the housing 11 and protrudes thorough the front wall of the housing 11 to the outside of the housing 11. A boss 35 protrudes from the front wall of the housing 11. The boss 35 receives the rotary shaft 13 through a bearing.

The pulley 17 includes a first pulley member 18 and a second pulley member 19. The first and second pulley members 18 and 19 are arranged in the identical axis. A belt 20 engages with the outer periphery of the first pulley member 18 from the engine E. A bearing 25 is interposed between the first pulley member 18 and the boss 35 of the housing 11. The first pulley member 18 is rotatably supported by the boss 35 of the housing 11 through the bearing 25.

A hub 30 is fixed to the front end of the rotary shaft 13. A first one-way clutch 31 is interposed between the hub 30 and the second pulley member 19. Namely, the first one-way clutch 31 is arranged on a first power transmission path between the rotary shaft 13 and the engine E. The second pulley member 19 is supported by the hub 30 through the first one-way clutch 31. The first pulley member 18 is connected to the second pulley member 19 through a power-transmitting pin 28 and a rubber damper 29. The power-transmitting pin 28 functions as a breaking type torque limiter. The rubber damper 29 helps to compensate the variation in the transmitted torque between both the pulley members 18 and 19.

The first one-way clutch 31 includes a roller type clutch mechanism 31*a* and a bearing 31*b*. With respect to a predetermined rotational direction, the clutch mechanism 31*a* permits power transmission from the second pulley member 19 to the hub 30, and blocks power transmission from the hub 30 to the second pulley member 19. When the electric motor unit 38 is in a stopped state and the first pulley member 18 is rotated by the drive of the engine E in the predetermined rotational direction, the second pulley member 19 is rotated through the power-transmitting pin 28 and the rubber damper 29 in the predetermined rotational direction. As a result, the rotational power of the second pulley member 19 is transmitted to the rotary shaft 13 through the first one-way clutch 31 and the hub 30.

On the other hand, when the engine E is in the stopped state and the rotary shaft 13 is rotated by the electric motor unit 38 in the predetermined rotational direction, the rotational power of the rotary shaft 13 is transmitted to the first one-way clutch 31 through the hub 30. However, since the clutch mechanism 31*a* of the first one-way clutch 31 blocks the power transmission from the hub 30 to the second pulley member 19, the power of the electric motor unit 38 is not transmitted to the engine E. Namely, the power of the electric motor unit 38 is utilized only for driving the compression unit 12 through the rotary shaft 13.

A sealed space 27 is defined in the first and second pulley members 18 and 19. A second one-way clutch 44 is arranged on the rotary shaft 13. The electric motor unit 38 includes a rotor 45 and a stator 49. The rotor 45 is mounted on the rotary shaft 13 through the second one-way clutch 44 in the sealed space 27. Namely, the second one-way clutch 44 is arranged on a second power transmission path between the rotary shaft 13 and the electric motor unit 38. The rotor 45 includes an iron core 45*a* and a coil 45*b* formed around the iron core 45*a*. The stator 49 is made of a magnet and is arranged around the outer periphery of the rotor 45 in the sealed space 27. Therefore, when electric power is supplied to the coil 45*b* from an external device, the rotor 45 is rotated.

The second one-way clutch 44 includes a clutch mechanism 44*a* and a bearing 44*b* similarly to the first one-way clutch 31. With respect to the predetermined rotational direction, the clutch mechanism 44*a* permits power transmission from the rotor 45 to the rotary shaft 13, and blocks power transmission from the rotary shaft 13 to the rotor 45.

Therefore, when the electric motor unit 38 is started, in a state when the engine E is in the stopped state, the rotational power of the rotor 45 is transmitted to the rotary shaft 13 through the second one-way clutch 44. On the other hand, when the electric motor unit 38 is in the stopped state and the rotary shaft 13 is rotated by the drive of the engine E, the rotational power of the rotary shaft 13 is not transmitted to the rotor 45. Therefore, a load on the engine E to drive the rotor 45 is reduced.

Next, an exemplary control device that constitutes a preferred hybrid compressor system with the compressor C will be described. As shown in FIG. 1, the control device for the compressor C includes an air conditioner ECU (Electric Control Unit) 51 that is similar to a computer, or a controller, an information detector 52 for communicating various information to the air conditioner ECU 51 and a driver 53 for driving the electric motor unit 38. The air conditioner ECU 51 is electrically connected to the information detector 52 and the driver 53. The information detector 52 includes various switches and various sensors (not shown) for detecting air conditioning information, such as an air conditioning switch and a temperature sensor. The information detector 52 also includes a rotational speed sensor 52*a* for detecting a rotational speed Ne of the engine E, or for detecting a rotational state of the engine E.

The air conditioner ECU 51 controls the switch of a drive source (electric motor unit 38/engine E) of the compressor C based on the air conditioning information and the rotational speed Ne of the engine E from the information detector 52. Namely, for example, when the vehicle is in an idle stop state (the engine E is in the stopped state), the air conditioner ECU 51 orders the driver 53 to start the electric motor unit 38 based on air conditioning (cooling) request, and the drive source of the compressor C is switched from the engine E to the electric motor unit 38. When the vehicle is in a normal running state (the engine E runs), the air conditioner ECU 51 orders the driver 53 to stop the electric motor 53, and the drive source of the compressor C is switched from the electric motor unit 38 to the engine E. The compression unit 12 of the compressor C is a variable displacement type. When the engine E runs and air conditioning is unnecessary, the air conditioner ECU 51 changes the displacement of the compressor C to the minimum.

Figure 2:
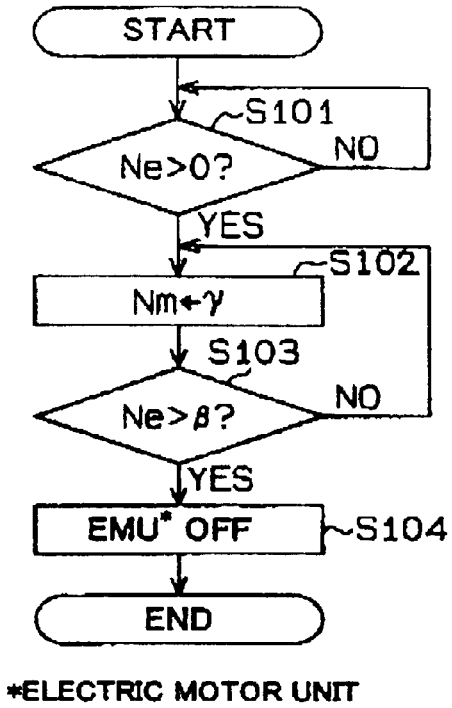
FIG. 2 is a flow chart Illustrating control for switching a drive source of the compressor from an electric motor unit to an engine.
Figure 3:
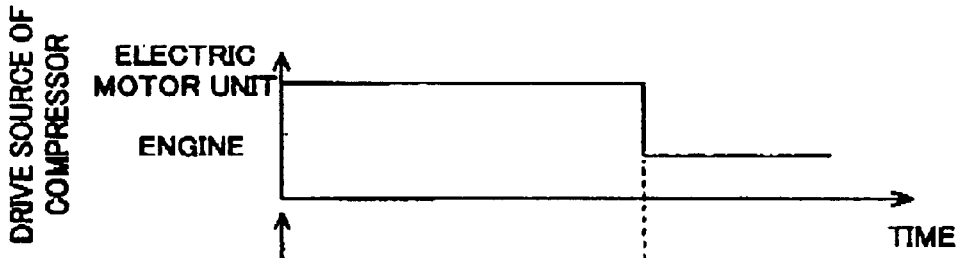
FIG. 3(*a*) Is a timing graph illustrating the drive source of the compressor.
Figure 3:
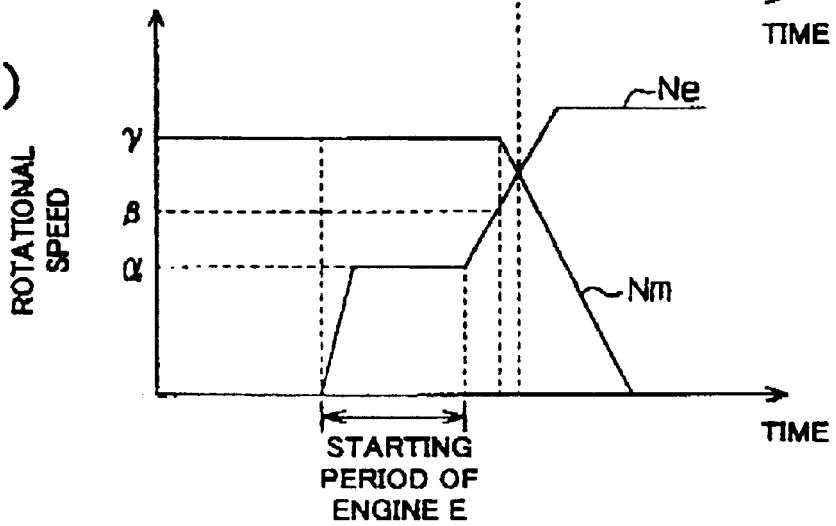

When the air conditioner ECU 51 switches the drive source of the compressor C from the electric motor unit 38 to the engine E, the air conditioner ECU 51 performs a preferred sequence control according to a pre-memorized program as shown in FIG. 2 through FIG. 3(*b*).

When the electric motor unit 38 is in the stopped state, the rotational speed of the compressor C (the rotary shaft 13) is determined based on a pulley ratio between the power transmission mechanism PT and the engine E and the information about the rotational speed Ne of the engine E from the rotational speed sensor 52*a*. The pulley ratio between the power transmission mechanism PT and the engine E is not one to one. For illustration purposes, however, the pulley ratio between the power transmission mechanism PT and the engine E is assumed as one to one in the present preferred embodiment.

As shown in FIG. 2, when the vehicle is in the idle stop state (the engine E is in the stopped state) and the compressor C is driven by the electric motor unit 38, in a step S101, the air conditioner ECU 51 monitors whether the starter motor S is started based on the information about the rotational speed Ne of the engine E from the rotational speed sensor 52*a*. Namely, the air conditioner ECU 51 monitors whether the engine E is changed from the stopped state to a rotational state (a dependent rotational state), more specifically, whether the rotational speed Ne of the engine E exceeds zero. If the judgment is NO in the step S101, or if the rotational speed No is zero, it is continuously monitored whether the starter motor S is started.

If the judgment is YES in the step S101, it is judged that the engine E is changed from the stopped state to the rotational state. The air conditioner ECU 51 orders the driver 53 to drive the electric motor unit 38 at a rotational speed Nm of a predetermined value γ in a step S102. When the electric motor unit 38 runs at the predetermined value γ of the rotational speed Nm, the electric motor unit 38 drives the compressor C at a second predetermined rotational speed of the compressor C that corresponds to a fourth rotational speed of the engine E. As shown in FIG. 3(*b*), the predetermined value γ corresponding to the fourth predetermined rotational speed of the engine E is higher than a predetermined value α of the rotational speed Ne of the engine E, or a third predetermined rotational speed of the engine E. The third predetermined rotational speed of the engine E corresponds to a first predetermined rotational speed of the compressor C. The predetermined value α is determined by the rotational speed of the starter motor S, that is, the predetermined value α corresponds to a theoretical rotational speed of the compressor C (the rotary shaft 13) when the compressor C is hypothetically driven by the starter motor S through the engine E. The theoretical rotational speed of the compressor C means a rotational speed of the compressor C when the power is hypothetically transmitted from the engine E that is driven by the starter motor S to the compressor C in a state that the electric motor unit 38 is in the stopped state. Namely, if the power is transmitted from the starter motor S to the compressor C through the engine E when the engine E is driven by the starter motor S, the compressor C is driven by the starter motor S at the theoretical rotational speed.

In FIG. 3(*b*), it is shown that the rotational speed Nm of the electric motor unit 38 is at the predetermined value γ even before the starter motor S starts for easy understanding. However, the rotational speed Nm of the electric motor unit 38 practically varies in accordance with a cooling load.

In a state when both the electric motor unit 38 and the engine E are in a rotational state, the first one-way clutch 31 alternates the two drive sources in such a manner that the first one-way clutch 31 permits power transmission from one drive source driving the compressor C at a higher speed than the other. Namely, when the electric motor unit 38 is capable of rotating the rotary shaft 13 faster than the engine E, the electric motor 38 rotates the rotary shaft 13. When the engine E is capable of rotating the rotary shaft 13 faster than the electric motor unit 38, the first one-way clutch 31 transmits the power from the engine E to the rotary shaft 13, and the engine E rotates the rotary shaft 13. Therefore, as mentioned above, when the electric motor unit 38 is driven at the rotational speed Nm of the predetermined value γ during the starting period of the engine E, the electric motor unit 38 drives the compressor C. Therefore, a load for driving the compressor C, during the starting period of the engine E, is applied to the electric motor unit 38, not to the starter motor S.

In a step S103, it is judged whether the rotational speed Ne of the engine E exceeds a predetermined value β, or a predetermined value. As shown in FIG. 3(*b*), the predetermined value β is lower than the predetermined value γ corresponding to the fourth predetermined rotational speed of the engine E and is higher than the predetermined value α of the rotational speed Ne of the engine E when driven by the starter motor S. When the rotational speed Ne of the engine E exceeds the predetermined value β, the engine E has successfully started up. If the judgment is NO in the step S103, the process switches to the step S102, and the rotational speed Nm of the electric motor unit 38 is kept at the predetermined value γ. Then, it is continuously monitored whether the engine E starts up in the step S103.

If the judgment is YES in the step S103, the process proceeds to a step 8104 where the air conditioner ECU 51 orders the driver 53 to stop the electric motor unit 38. Therefore, as shown in FIG. 3(*b*), the relationship between the rotational speed Ne of the engine E and the rotational speed Nm of the electric motor unit 38 is inverted. As shown in FIG. 3(*a*) and FIG. 3(*b*), when the rotational speed Ne of the engine E becomes higher than the rotational speed Nm of the electric motor unit 38, the drive source of the compressor C is automatically and immediately switched from the electric motor unit 38 to the engine E through the first one-way clutch 31 without an external control such as an electromagnetic clutch.

The following effects are obtained in the above-constructed present preferred embodiment.

(1) As mentioned above, the electric motor unit 38 is stopped after the engine E starts up. Therefore, due to the simple control, the drive source of the compressor C is smoothly switched from the electric motor unit 38 to the engine E without a break of air conditioning. The simplification of the control reduces a computing load on the air conditioner ECU 51.

(2) When the drive source of the compressor C is switched from the electric motor unit 38 to the engine E, the electric motor unit 38 is stopped at a suitable time after the engine E starts up. This preferred operational sequence promotes startability of the engine E. It is assumed that the electric motor unit 38 is stopped before the engine E starts up, or during the starting period of the engine E. In this case, the drive source is switched from the electric motor unit 38 to the engine E during the starting period of the engine E. Therefore, startability of the engine E deteriorates. To avoid the problem, the electric motor unit 38 is stopped after the engine E starts up in the present preferred embodiment.

Particularly, in the present preferred embodiment, the driver 53 is ordered to drive the electric motor unit 38 at the rotational speed higher than the theoretical rotational speed of the compressor C, which determined by the rotational speed of the starter motor S, during the starting period of the engine E. Therefore, the compressor C is driven by the electric motor unit 38 during the starting period of the engine E. If the drive source of the compressor C is switched from the electric motor unit 38 to the engine E (strictly the starter motor 8 for starting the engine E) during the starting period of the engine E, a load on the starter motor S increases. However, the drive source is switched from the electric motor unit 38 to the engine E after the engine E starts up. Therefore, the load on the starter motor 5 does not increase. As a result, the startability of the engine E is satisfactory even by a small starter motor S.

The following alternative embodiments may be practiced according to the present invention.

When the drive source of the compressor C is switched from the electric motor unit 38 to the engine E, the electric motor unit 38 is stopped as soon as the rotational speed Ne of the engine E exceeds the predetermined value β in the present preferred embodiment. The electric motor unit 38 may be stopped at a predetermined period after the rotational speed No of the engine E exceeds the predetermined value β (for example with a timer), or the air conditioner ECU 51 may delays for a predetermined period to stop the electric motor E after the rotational speed Ne of the engine E exceeds the predetermined value β.

When the drive source of the compressor C is switched from the electric motor unit 38 to the engine E, the electric motor unit 38 may be stopped after the starter motor S starts up (the rotational speed Ne of the engine E becomes equal to the predetermined value α). In this alternative embodiment, the drive source of the compressor C is not switched from the electric motor unit 38 to the engine E during an initial period when the rotational speed of the starter motor S is increased (when the rotational speed Ne is smaller than the predetermined value α). Therefore, a load on the starter motor S can be reduced for starting the motor S, and the starter motor S can be miniaturized.

Although the roller type first one-way clutch 31 is used in the preferred embodiment, the one-way clutch 31 may be changed to other types of one-way clutches such as, for example, a sprag type. The first one-way clutch 31 may not include the bearing 31*b*.

In the preferred embodiment, the electric motor unit 38 is installed in the power transmission mechanism PT. The electric motor unit 38 may be accommodated in the housing 11 with the compression unit 12, or the electric motor unit 38 may be arranged separately from the compressor C.

The compression unit 12 is not limited to the piston type. The compression unit 12 may be a scroll type, a vane type and a helical type.

Therefore, the present examples and embodiments are to be considered as illustrative and not restrictive, and the invention is not to be limited to the details given herein but may be modified within the scope of the appended claims.

What is claimed is:

1. A hybrid compressor system comprising:

a hybrid compressor for compressing refrigerant;

a first drive source operatively connected to the compressor through a first power transmission path;

a second drive source operatively connected to the compressor through a second power transmission path, the compressor being selectively driven by one of the first drive source and the second drive source;

a first one-way clutch arranged on the first power transmission path between the compressor and the first drive source for permitting power transmission from the first drive source to the compressor;

a driver for driving the second drive source;

a sensor for detecting a rotational state of the first drive source; and a controller electrically connected to the driver and the sensor, the controller, when a drive source of the compressor is switched from the second drive source to the first drive source, ordering the driver to stop the second drive source after the rotation of the first drive source is detected.

2. The hybrid compressor system according to claim 1, wherein the second drive source is an electric motor.

3. The hybrid compressor system according to claim 2, wherein the first drive source is an engine.

4. The hybrid compressor system according to claim 3, wherein the controller orders the driver to stop the electric motor after the engine starts up.

5. The hybrid compressor system according to claim 4, further comprising a starter motor operatively coupled to the engine.

6. The hybrid compressor system according to claim 5, wherein the controller orders the driver to drive the electric motor, during a time when the starter motor starts the engine, such that the electric motor drives the compressor at a second predetermined rotational speed for blocking power from the starter motor, the second predetermined rotational speed being higher than a first predetermined rotational speed, at which the compressor is driven when the power is hypothetically transmitted from the starter motor to the compressor through the engine in a state that the electric motor is in a stopped state.

7. The hybrid compressor system according to claim 6, wherein the sensor detects that the detected rotational speed of the engine exceeds a predetermined value.

8. The hybrid compressor system according to claim 7, wherein the controller orders the driver to stop the electric motor when a detected rotational speed of the engine exceeds the predetermined value, the predetermined value ranging between a third predetermined rotational speed of the engine that corresponds to the first predetermined rotational speed of the compressor and a fourth rotational speed of the engine that corresponds to the second predetermined rotational speed of the compressor.

9. The hybrid compressor system according to claim 8, wherein the controller delays for a predetermined period to stop the electric motor after the detected rotational speed of the engine exceeds the predetermined value.

10. The hybrid compressor system according to claim 6, wherein the controller orders the driver to stop the electric motor when the detected rotational speed of the engine becomes equal to a third predetermined speed that corresponds to the first rotational speed of the compressor.

11. The hybrid compressor system according to claim 1, further comprising a second one-way clutch arranged on the second power transmission path between the compressor and the second drive source for permitting power transmission from the second drive source to the compressor.

12. The hybrid compressor system according to claim 1, wherein the compressor is a piston type variable displacement compressor.

13. A method for switching a drive source of a hybrid compressor from a stopped state of an engine for running a vehicle to a normal running state, the compressor being operatively connected to the engine through a power transmission path, the compressor being selectively driven by one of the engine and an electric motor, a starter motor being operatively connected to the engine, the method comprising the steps of:

arranging a one-way clutch on the power transmission path between the compressor and the engine;

driving the compressor by the electric motor during an idle stop state of the vehicle;

detecting a rotational speed of the engine; and driving the electric motor such that the electric motor drives the compressor at a second predetermined speed when the rotational speed of the engine is detected; and stopping the electric motor when the detected rotational speed of the engine exceeds a predetermined value, wherein the predetermined value ranges between a third predetermined rotational speed of the engine that corresponds to a first predetermined rotational speed of the compressor and a fourth rotational speed of the engine that corresponds to the second predetermined rotational speed of the compressor, the compressor being driven at the first predetermined rotational speed when power is hypothetically transmitted from the starter motor to the compressor through the engine in a state that the electric motor is in a stopped state.

* * * * *